US005114272A

United States Patent [19]

Brunhoff et al.

[11] Patent Number: 5,114,272

[45] Date of Patent: May 19, 1992

[54] DETACHABLE BOOM AND METHOD FOR ITS USE

[76] Inventors: Frederic P. Brunhoff, P.O. Box 4071, Kodiak, Ak. 99615; Enok P. Lian; Libbie B. Lian, both of P.O. Box 106, Cordova, Ak. 99574

[21] Appl. No.: 547,952

[22] Filed: Jul. 2, 1990

[51] Int. Cl.[5] ..... E02B 15/06; A01K 71/00

[52] U.S. Cl. ..... 405/66; 43/7; 405/72

[58] Field of Search ..... 405/63-72; 210/923, 924; 43/7, 9.1, 9.8, 9.95

[56] References Cited

U.S. PATENT DOCUMENTS 3,537,587 3/1970 Kain .
3,563,036 2/1971 Smith et al. .
3,565,257 2/1971 Cavalieri .
3,613,376 10/1971 Midby .
3,638,429 2/1972 Sladek et al. .
3,653,213 4/1972 Childers .
3,664,504 5/1972 Ayers et al. ..... 405/66 X
3,667,235 6/1972 Preus et al. .
3,695,042 10/1972 Denison .
3,701,258 10/1972 Rhodes .
3,718,001 2/1973 Harper .
3,768,656 10/1973 Nugent .
3,775,982 12/1973 Lamboley .
3,783,621 1/1974 Preus et al. .
3,803,848 4/1974 Van't Hof .
3,807,177 4/1974 Oberg .
3,852,978 12/1974 Fossberg ..... 405/72 X
3,859,797 1/1975 Ayers ..... 405/72
3,919,847 11/1975 Ballu .
3,921,407 11/1975 Neal .
3,939,663 2/1976 Tezuka et al. .
3,943,720 3/1976 Milgram .
4,000,618 1/1977 Stovall .
4,062,191 12/1977 Preus ..... 405/72
4,096,700 1/1978 Muramatsu et al. .
4,102,789 7/1978 Young ..... 405/66 X
4,146,344 3/1979 Steen et al. .
4,174,185 11/1979 Taki .
4,174,186 11/1979 Kasai et al. .
4,188,155 2/1980 Langermann .
4,190,381 2/1980 Knaus et al. .
4,237,237 12/1980 Jarre et al. .
4,248,547 2/1981 Brown .
4,300,856 11/1981 Magoon et al. .
4,310,415 1/1982 Webb .
4,333,726 6/1982 Fuxelius .
4,422,797 12/1983 McAllister et al. .
4,432,874 2/1984 Lundin .
4,507,017 3/1985 Magoon .
4,537,528 8/1985 Simpson ..... 405/72
4,619,553 10/1986 Fischer .
4,640,645 2/1987 Simpson et al. .
4,645,376 2/1987 Simpson .
4,652,173 3/1987 Kallestad ..... 405/69
4,692,059 9/1987 Juutilainen .
4,781,493 11/1988 Fischer .
4,802,791 2/1989 Fisher et al. .

*Primary Examiner*—David H. Corbin

[57] ABSTRACT

The present invention discloses a detachable boom for containing and recovering fluids spilled on open water. The invention has a float system using a plurality of floats arrayed along a flexible, stretch-resistant cork line, a substantially rectangular barrier where the barrier is fixedly but detachably attached to the float system by a first attachment system, and an elongated weight device which is fixedly but detachably attached to the bottom of the barrier. The detachable boom disclosed in the present invention can be anchored in a stationary position or towed behind a small-to-medium sized marine vessel using a towing bridle.

20 Claims, 13 Drawing Sheets

FIG. 1B
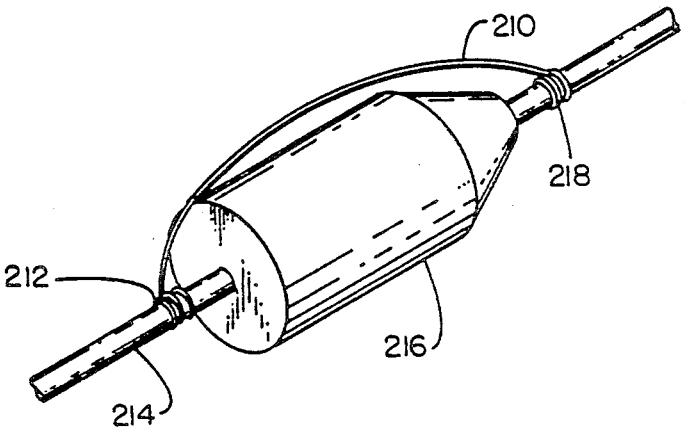
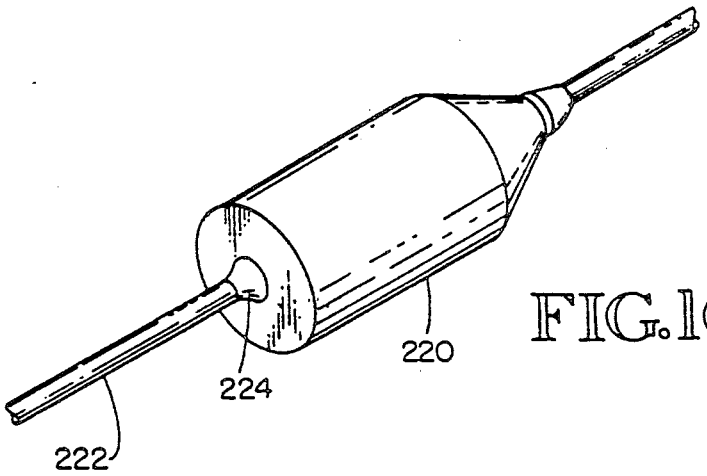
FIG. 1C

FIG.5
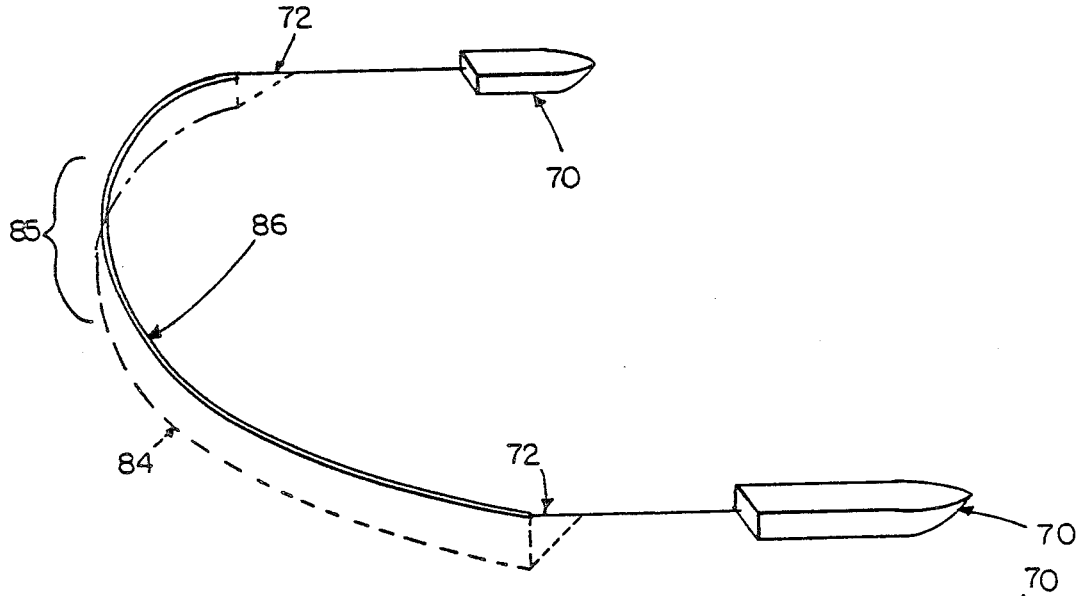
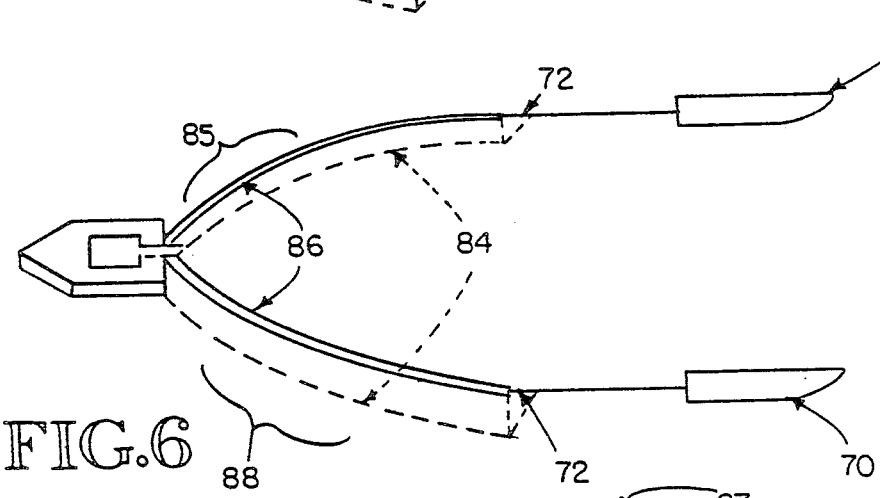
FIG.6
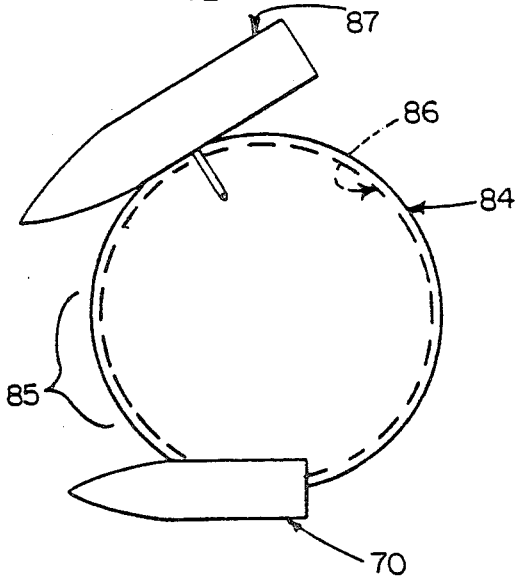
FIG.7

DETACHABLE BOOM AND METHOD FOR ITS USE

TECHNICAL FIELD

This invention relates to a detachable boom for containing and recovering spilled fluids such as crude oil from the surface of open water. More particularly, this invention relates to a detachable boom attached to a float system with a plurality of individual floats by an attachment system, a barrier which wraps around the float system and which can be made from a non-woven "geotextile" fabric which is suspended downwardly from the float system, and an elongated weight device which is snapped or otherwise attached to the bottom of the barrier. The invention is designed so that it can be used on small fishing vessels by their operators with little or no instructions and no special handling equipment. The attachment used with the float system and elongated weight device can be adapted so that it also can be used with commercial fishing nets.

BACKGROUND OF THE INVENTION

The design and use of floating boom devices for containing fluid spills, such as crude oil, on open water is well known. Examples of such typical devices are disclosed in Magoon at al. U.S. Pat. No. 4,300,856 and Brown U.S. Pat. No. 4,248,547. As the transportation of fluids such as crude oil by water and the catastrophic affects from the inadvertent release of such fluids has increased, the importance of effective containment and recovery systems has increased.

In the last ten to fifteen years a growing number of water permeable (also known as hydrophobic) and oil absorbent (also known as oleophilic) materials have become known and are used in containment booms since they also allow the recovery of crude oil while they are containing the spill. Some examples of booms utilizing such materials are Cavalieri U.S. Pat. No. 3,565,257, Preus et al. U.S. Pat. No. 3,667,235, Kain U.S. Pat. No. 3,537,587, and Neal U.S. Pat. No. 3,921,407.

While booms using these materials generally can be more effective in containing and recovering spilled hydrocarbons, they still suffer from a number of shortcomings that are not alleviated simply by employing water permeable/oil absorbent material. One of the biggest shortcomings is that most booms have an inability to maintain their carrier effect in rough or choppy waters. Both the extended horizontal cylindrical-type barriers as exemplified in the Cavalieri patent and the "fencepost" design as exemplified by the Neal patent have a limited ability to ride rough water. Despite attempts to improve the ability of booms to assimilate wave action in rough or choppy waters, earlier boom systems tend to be washed over by the waves with spill material or they ride up on wave and allow fluids to pass under them.

There are also problems which revolve around the bulkiness of the barriers, difficulty in transporting the barriers to spill sites, and special equipment or training required to utilize the barriers when at the spill site. In particular, most existing booms do not fit very well on the decks of small to medium sized vessels or in the storage areas of those vessels. The relatively slow speed with which most booms can be deployed is also a limitation of earlier examples of booms. Another problem of earlier types of spill containment booms is that once the booms have become soiled they must be cleaned or may even have to be discarded. Even with booms which allow their barrier portion to be changed, typically it is difficult and time consuming to replace the barrier portion, and there is the problem of disposing of the soiled portion of the boom.

This problem is related to the difficulties commercial fishermen face with their nets. In order to fish in different bodies of water with varying water conditions, i.e. depth of the body of water, and strength and direction of local currents, fishermen are required to have a variety of nets. The nets have different combinations of weight devices, floats, and dimensions of the net itself. Since commercial fishing nets are expensive to produce and expensive to maintain, commercial fishermen who desire to fish in varying water conditions must invest substantial amounts of money for a variety of fishing nets. They are also faced with the problem of maintaining and storing this variety of nets.

Undoubtedly, the greatest overlooked resource in fighting oil spills, whether it is in Prince William Sound in Alaska or the gulf coast of Texas, is the multitude of small and medium-sized fishing vessels which have both the equipment and personnel specifically experienced in deploying boom-like devices into the water, moving through the water with the devices deployed, and recovering both the devices and materials contained in the devices. In addition, local fishermen are frequently the mariners with the greatest knowledge of the local water conditions, currents, etc. Also, they frequently are most knowledgeable about the location of those areas most ecologically sensitive to damage by spilled hydrocarbon such as crude oil.

Even when local fisherman are employed to combat oil spills, they are frequently saddled with cumbersome booms that cannot be accommodated with the equipment on their boats, and which requires special instructions and special equipment to be used. Thus, the parties charged with containing and recovering spilled hydrocarbons may very be neglecting what can be one of the most effective weapons in combating the economic and ecological disasters that almost always accompany the inadvertent release of hydrocarbons such as crude oil on the open water.

As illustrated by the above discussion, there are a number of desirable features for a detachable boom for containing and recovering spilled hydrocarbons such as crude oils have. It would be desirable to have a boom with a float system that has the ability to assimilate wave action on rough or choppy water, thus allowing the boom to maintain its barrier effect. It would be desirable to have a boom which incorporates a water-permeable, oil absorbent barrier that could be used by local fishermen on their small to medium sized fishing boats. Further, it would be desirable to have a boom that does not require any special equipment or special training to use. In addition, it would be desirable to have a boom that is relatively simple and inexpensive to manufacture, assemble, use, and repair. Further, it would be desirable to have a boom that could be deployed very quickly at a spill site. It also would be desirable to have a boom that could be towed trough an area with an oil spill in a manner similar to that of a fishing net. It is additionally desirable to have a boom that is relatively lightweight and easy to handle in adverse conditions. It would be further desirable to have a boom with an attachment system that would enable the boom to be easily assembled and disassembled, enabling the component parts to be changed or interchanged. It would be further desirable to have a boom the parts of which could be either cleaned or disposed of in an ecologically sound manner.

While the discussion herein relates to a detachable boom designed to contain and recover spilled hydrocarbons such as crude oil, it is not intended that the invention be limited to this situation. It will be obvious from the description that follows that the present invention will be useful in other applications with problems common to those described herein, including problems found in the commercial fishing industry.

SUMMARY OF THE INVENTION

It is the object of the present invention to provide an detachable boom which has a barrier constructed from water permeable, oil absorbent material that can also be used on small and medium sized fishing boats.

It is also the object of the present invention to provide a detachable boom which can be used without special equipment or training.

It is the further object of the present invention to provide a detachable boom that is relatively simple and inexpensive to manufacture, assemble, use, and repair.

It is yet another object of the present invention to provide a detachable boom that has the ability to assimilate wave action, thereby maintaining its barrier effect.

It is an additional object of the present invention to provide a detachable boom that can be quickly deployed at the site of a fluid spill.

It is also the object of the present invention to provide a detachable boom which can be towed, preferably by a small to medium sized fishing vessel, through water where hydrocarbons such as crude oil has been spilled.

It is yet a further object of the present invention to provide a detachable boom which can be easily expanded without deterring from its containment capabilities.

It is the additional object of the present invention to provide a detachable boom that can be easily assembled from and disassembled into its component parts to allow ready replacement or interchange of those parts.

It is also the object of the present invention to provide a detachable boom which has component parts that may either be cleaned or disposed of in an environmentally sound way.

The present invention achieves these and other objectives which will become apparent from the description that follows, by providing a detachable boom which uses a float system made up of a plurality of floats with the floats fixedly attached to and arrayed along a flexible, but stretch-resistant cork line. Attached to and suspended from the cork line is a barrier which is substantially rectangular in shape and can be manufactured from a number of different materials. When the detachable boom is deployed, the barrier extends downward several feet into the water several feet. The barrier is attached to the float system by a first attachment system. Attached to and arrayed along the bottom of the barrier is an elongated weight device, which also is flexible but stretch resistant. The elongated weight device is attached to the barrier with a second attachment system.

In use, the detachable boom with its float system utilizing the plurality of floats on the flexible cork line is very effective at assimilating wave action from rough or choppy waters, and thereby is very effective at containing spilled fluid such as crude oil by preventing polluted water from splashing over or passing under the detachable boom. Also, the detachable boom whether assembled or in component form is easily stored on the decks and in the existing storage areas of the small and medium sized fishing vessels. The float system and elongated weight device can be repeatedly cleaned and reused.

In an alternative preferred embodiment of the present invention, the first attachment system used to attach the barrier to the float system actually uses part of the barrier itself. The top portion of the barrier is folded around the floats and the barrier top is attached to the barrier surface substantially along its length. This encloses the float system with its plurality of floats within the barrier. The attachment system of this embodiment is particularly useful when quick-release snaps are used to attach the edge of the barrier to enclose the float system. The quick-release allows the barrier to be changed quickly should it become too soiled for further use or should a different type of material be desired. Further, the attachment system of this embodiment enables the detachable boom system to be transported or stored in a disassembled state, that is, with the float system, the barrier, and the elongated weight device separate. When used in this manner, the detachable boom may be assembled as it is being deployed from the boat.

When the attachment system of this embodiment is used with a barrier made from a water permeable, oil absorbent material such as non-woven "geotextile" fabric, it is particularly effective in containing spilled fluids such as crude oil. In the unlikely event that there is some polluted water splashed over the top of the barrier, the crude oil will hit the layer of non-woven "geotextile" fabric that is folded over the top of the float instead of a float. The non-woven "geotextile" fabric will tend to absorb that small amount of crude oil which does splash over the top of the detachable boom.

In yet another alternative preferred embodiment, a snapless, quick release material such as Velcro is used instead of snaps in the attachment systems and other connections in a detachable boom that substantially similar to the embodiments described above.

In an additional alternative preferred embodiment, the elongated weight device is a weighted lead line extended across and attached to the bottom of the barrier. The second attachment system is similar to the first attachment system described in the above alternative embodiment. Thus, the bottom of the barrier is folded in an upwardly direction to enclose the weighted lead line within the barrier. The bottom edge of the barrier then is attached to the barrier along its length.

Another alternative preferred embodiment uses a different second attachment system to attach the elongated weight device to the bottom of the barrier. This preferred embodiment uses a plurality of closed loops constructed of a flexible, substantially stretch-resistant material which are arrayed along the barrier bottom. In turn, the elongated weight device is fixedly attached along its length to the loops of material with quick-release snaps or other attachment devices, which results in the elongated weight device being suspended from and fixedly attached to the barrier bottom along its length by the plurality of loops.

In yet another alternative preferred embodiment of the present invention, a detachable boom as described in the above preferred embodiment is attached to and towed by a marine vessel, such as a small to medium sized fishing boat. The detachable boom is connected to the vessel by a towing bridle which connects to the detachable boom's fork line on either end of the boom and to the elongated weight device on either end. In turn, the towing bridle is attached to a tow line extending from the rear of the marine vessel. When the towing vessel is in motion, the boom is pulled forward by the towing bridle which is configured so that the barrier portion of the detachable boom is curved backward between and along the float system at the barrier top and the elongated weight device at the barrier bottom. This embodiment the barrier creates a cupping effect with the "cup" open in the direction that the boom is being towed. This enhances the detachable boom's ability to capture and contain spilled fluids such as crude oil. The detachable boom can be effective in applications in which it is anchored in a stationary position in the body of open water. The detachable boom described in the above embodiments has proved effective in water speeds, which are the combined speed of any currents with the speed of the boom itself, of seven to ten knots. It is possible that boom effectiveness may continue at water speeds in excess of fifteen knots.

An additional alternative preferred embodiment uses an attachment system described in the above preferred embodiment that involves holding the top of the barrier over a closed system or elongated weight device in connection with commercial fishing nets. In this embodiment, float systems and elongated weight devices described above, may be used with a standard net or a modified net section. If the standard net is used, its top and bottom portions are folded around the float system and elongated weight device respectively. If the modified net section is used, it has substantially solid sections extending along its length at the net section top and bottom edges. A commercial net in this embodiment is assembled exactly as the detachable boom described above, with the top solid section folded around the float system and the bottom solid section folded around the weight device. This embodiment would enable a commercial fisherman to adapt their fishing nets to a variety of water conditions with a relatively small number of component parts.

A further alternative preferred embodiment allows individual sections of detachable booms constructed in accordance with the embodiments described above to be joined together to create longer versions of the detachable boom.

An additional alternative preferred embodiment provides a bag containing a section of detachable boom as described in the above embodiments. The ends of the boom are color coded so that when the boom is to be deployed, the end to be deployed first is immediately recognizable and is pulled from the bag. At the same time, the other end of the boom which is also visible is taken from the bag and either attached to the vessel or attached to the first end of a second boom. The bag can also serve as a storage container for the soiled barrier after the boom's use. A bag constructed of water permeable, oil absorbent material is particularly suited as a storage container since it will allow water to exit while holding hydrocarbon waste.

BRIEF DESCRIPTION OF THE DRAWINGS

FIG. 1B is a partial side elevation view of an element of a preferred embodiment constructed in accordance with the present invention.

FIG. 1C is a partial side elevation view of an element of an alternative preferred embodiment constructed in accordance with the present invention.

FIG. 5 is a perspective environmental view showing the use of an alternative preferred embodiment constructed in accordance with the present invention.

FIG. 6 is a perspective environmental view showing the use of an alternative preferred embodiment constructed in accordance with the present invention.

FIG. 7 is a top plan view of an alternative preferred embodiment constructed in accordance with the present invention.

BEST MODE IN CARRYING OUT THE INVENTION

Figure 1:
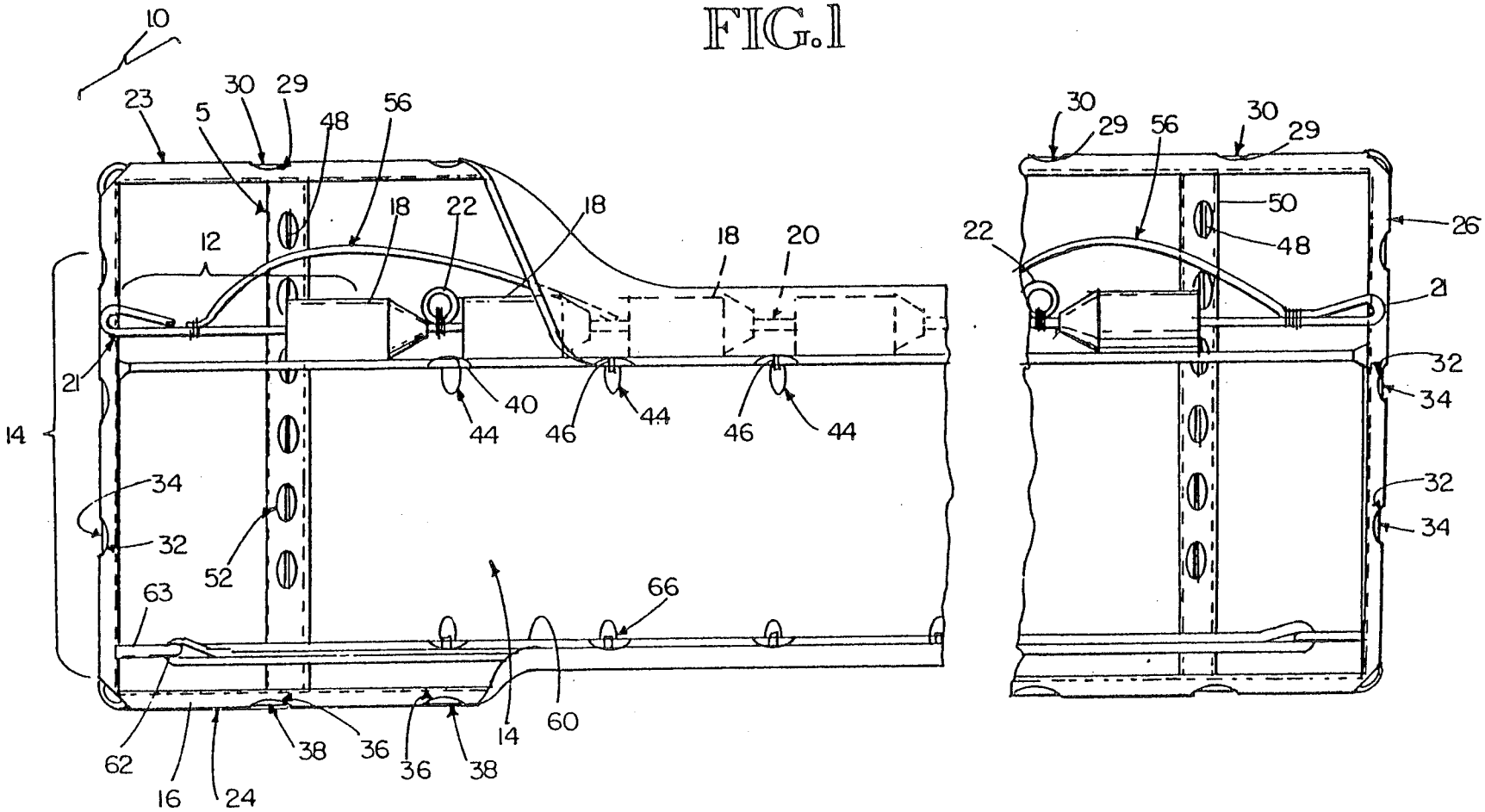
FIG. 1 is a side elevation view of a preferred embodiment constructed in accordance with the present invention.

With reference to FIG. 1, a detachable boom 10 is shown. The detachable boom has a float system 12, a barrier 14 that is fixedly, but detachably, attached to the float system, and an elongated weight device 16 that is attached to and arrayed along the bottom of the barrier. The float system as shown in FIG. 1 has a plurality of floats 18 arrayed along and fixedly attached to a flexible, but stretch-resistant line known as a cork line 20 with end loops 21. A ring 22 is attached to the cork line. The ring is constructed from stainless steel or other rigid material. The float can take many shapes, circular, ovular, square, etc. Regardless of the shape, the floats have a cross-section perimeter length, which is the distance around the float at its cross-section.

While the float system can have a variety of configurations with different materials used for the float itself, success has been obtained using cylindrical floats made of expanded polyvinylchloride fixedly attached to the cork line in an array at regular intervals. As to the cork line itself, any number of commercially available lines well known in the art may be used. One line that has been used successfully is a five-eighths inch polypropylene and dacron blend line known as Polyplus TM.

The float of the float system can be attached to the cork line in a variety of ways. Some earlier methods involved using a smaller line 210 which is tied with a number of knots 212 to the cork line 214 on one end of the float 216, passed around the float and tied to the cork line on the opposite end of the float, again with a number of knots 218, as shown in FIG. 1B. Such procedure is labor intensive, time consuming, and thus, expensive. Some success has been achieved in attaching floats to cork lines with a polyvinylchloride spray foam 224 which is commercially available in retail stores. The float 220 is moved along the cork line 222 until it is in the desired position. The polyvinylchloride foam spray is sprayed at either end of the float near and on the cork line, as shown in FIG. 1C. Once the spray foam has hardened, the float is fixedly attached to the cork line. Such installation has proven durable and weather resistant, moisture resistance, and pollutant resistant.

As shown in FIG. 1, the barrier is a substantially rectangular piece of material with four edges, a top 23, bottom 24, two ends 26, a front surface 27, and a back surface 28. Success has been achieved with detachable booms that have barriers that extend into the water as little as 18 inches. While more typical depths for the barrier portion of the boom is three-to-six feet, booms with barriers extending downwardly into the water as deep as 30 feet have proven to be quite effective. At this time, the limits on the depth of the barrier which corresponds to its width dimension is dictated more by practical consideration, which is the ability to transport it, and water conditions, than any actual limits on the depth of the barrier itself.

Similarly, the length of the boom barrier can vary greatly. Shorter sections for use in smaller bodies of water such as narrow inlets or in harbors can be easily produced. Limit in the length of the barrier, as with the width is dictated more by practical consideration with the handling and deployment than any limitation on the construction or materials used. Great success has been achieved with barriers approximately 100 feet long. Experience with detachable booms indicate that length over approximately 150 feet begin to present practical problems with handling and transportation that outweigh any advantage achieved by greater length.

Figure 1A:
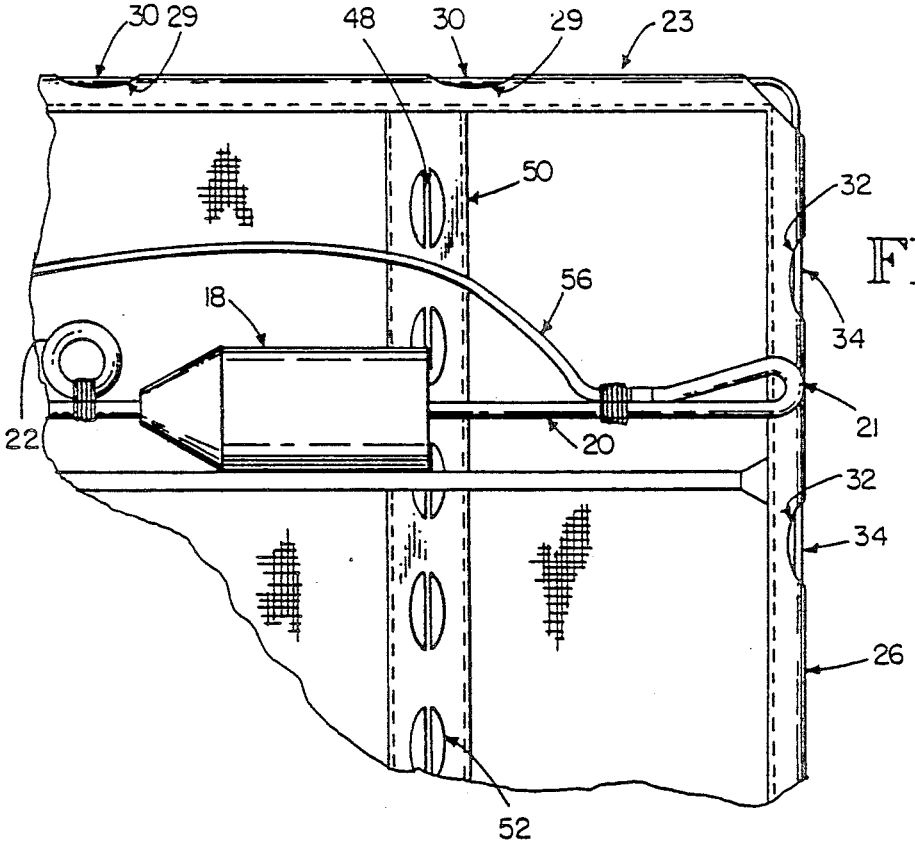
FIG. 1A is a partial side elevation view of a preferred embodiment constructed in accordance with the present invention.
Figure 3:
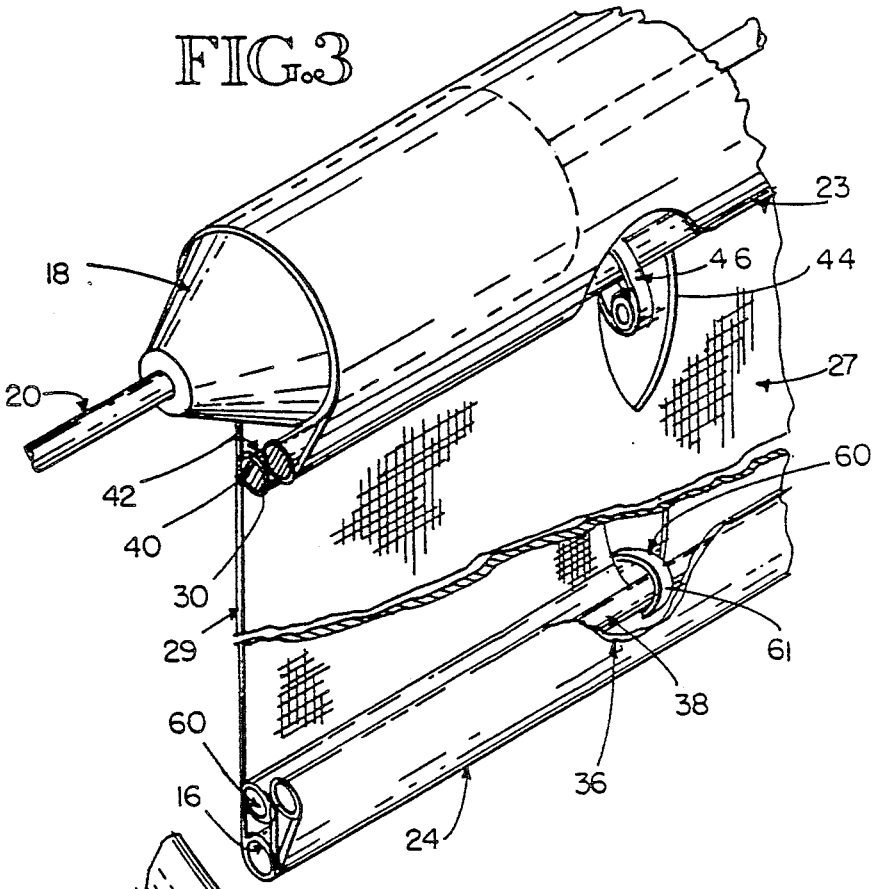
FIG. 3 is a cross-sectional view of a preferred embodiment constructed in accordance with the present invention taken along lines 3—3 in FIG. 1.

The barrier is attached at its top to the float system using a first attachment system. The first attachment system can take a number of forms. The attachment system illustrated in FIGS. 1, 1A, and 3 involves folding the top of the barrier system over and around the float system with its plurality of floats along its length and attaching the barrier top back to the barrier itself. In this embodiment, a plurality of top edge slots 29 are cut into the barrier. The top edge slots are substantially aligned along an axis that is parallel to the barrier top edge and relatively near the top edge. A top edge line 30 lays across an aligned set of top edge slots. The barrier top edge is folded over the top edge line and attached to the barrier. The attachment of the barrier top edge to the barrier can be achieved by sewing, stapling, or any other procedure that provides a sufficiently strong connection between the top edge and the barrier along their lengths. The result as shown in FIGS. 1, 1A and 3 is that the top edge line is enclosed within a fold of the barrier material and is exposed at intervals through the top edge slots. Edge slots and edge lines are assembled in the same manner for the other three edges of the barrier bottom and ends. As shown in FIG. 1, the barrier when constructed has end edge slots 32, end edge lines 34, bottom edge slots 36, and bottom edge lines 38. Thus, on every barrier edge there is an edge line exposed at intervals through edge slots.

The top fastening line 40 is fixedly attached to and extends substantially the length of the barrier. The top fastening line is positioned so that it is substantially parallel to and some distance below the barrier top edge. This distance is generally equal to or greater than the cross-sectional perimeter length of the floats. The top fastening line can be fixedly attached to the barrier in a number of ways. As shown in FIG. 3, the top fastening line is sewn into a fold 42 of the barrier. Staples could also be used to fixedly attach the top fastening line to the barrier. Also, an additional strip of material can be placed over the top fastening line and then sewn to the barrier (not shown). Regardless of the manner in which it is attached to the barrier, the top fastening line is substantially concealed within the barrier material. At intervals corresponding to the positioning of the top edge slots, a plurality of top fastening slits 44 are cut through the barrier material to expose the top fastening line. The edge lines and fastening lines for the present invention can be made from any commercially available line with sufficient strength. One-quarter inch polypropylene line has been used with success.

To attach the float system to the barrier, the float system with its cork line and plurality of floats is then placed along the length of the barrier between the barrier top edge and the top fastening line. The barrier top edge then is folded over the float system until the top edge is proximate the top fastening line substantially along the barrier length. Snap devices 46 may then be placed around the top edge line and the top fastening line at each corresponding top edge slot and top fastening slit, thereby holding the top edge line and the top fastening line together at the edge point. When the snapping devices have been used along the length of the barrier, the result is that the float system with its plurality of floats is enclosed within a fold of the barrier and the barrier top is fixedly attached to the barrier along the top fastening line.

The first attachment system described above enables the barrier to be quickly attached to the float system. This speed of attachment allows the barrier to be changed if it becomes too soiled for further use or if a different type of barrier material is desired. Further, it allows the detachable boom to be transported and stored with the float system and barrier separate. They can then be assembled at or near the spill site or may even be assembled as the detachable boom is being deployed. The resultant detachable boom is easily stored on the decks or in existing storage areas, such as fish holds, on small and medium sized marine vessels without modification. Of course, a detachable boom of this embodiment is used quite readily on specially designed boom vessels.

Two end fastening lines 48 are fixedly attached to and extend substantially along the barrier width. Each end fastening line is substantially parallel to and inset from the corresponding end edge. As shown in FIG. 1, one way to fixedly attach the end fastening line to the barrier is to place a relatively thin strip of material 50 over the line and sew the material to the barrier. In this embodiment, a plurality of end fastening slits 52 are cut in the material covering the end fastening line. The end fastening slits are substantially aligned and expose the end fastening line.

To help anchor the float system to the barrier, security straps 56 then are attached to either end of the float system. The ends 58 of the security straps are fixedly attached to the cork line. At either end of the cork line where it extends to the end of the barrier, security straps are near the top edge slots and fastening slits and are substantially parallel to the top edge and fastening lines. The security straps also are proximate the end edge and fastening lines. To ensure proper connection to anchor the float system and barrier together, the security straps are attached to at least one of the various exposed lines that the security straps are proximate by quick- release snap devices or other device, such as plastic wire ties. At least two to three different connections appear to be necessary to ensure complete anchoring of the barrier when the boom is towed. By providing these attachments between the cork line and the barrier directly any tendency of the float system to pull through and out of the enclosing barrier fold is diminished.

The elongated weight device can be attached to the bottom of the barrier with a second attachment system similar to the attachment system described above for attaching the barrier to the float system. A bottom fastening line 60 extends substantially the length of the barrier, and is substantially parallel to and proximate the barrier bottom edge. Since the diameter of the elongated weight device is typically much less than that of the float or the float system, the distance between the bottom fastening line and the barrier bottom is considerably less in most circumstances. Typical distances from between the bottom fastening line and the barrier bottom range from three to eight inches as compared to eighteen inches to three feet for the distance between the top fastening line and the barrier top.

The bottom fastening line is permanently affixed to the barrier and is exposed at a plurality of intervals by bottom fastening slits cut into the barrier material. As with the above attachment system, the bottom of the barrier is folded over the elongated weight device which is placed between the bottom fastening line and the bottom of the barrier. When bottom edge slots 36 are proximate the bottom fastening slits, snap devices 61 are placed around the exposed bottom edge line 38 and the bottom fastening line.

The elongated weight device itself must be relatively heavy, and very flexible, but at the same time extremely stretch resistant. Any material that has these characteristics can be used as the elongated weight device Success has been had using lead line, which is a woven line with a hollow core filled with lead weights. Relatively heavy metal chain can also be used as the elongated weight device. The elongated weight device has end loops 62 with rings 63 in them for ease of connections.

Snaps placed through the rings can be used to provide additional secure connections between the barrier and the weight device. Also, the elongated weight device can be secured to the barrier using other devices such as plastic wire ties as can be done with the float system. The quick release snaps can be replaced in a number of areas in the present invention such as in the first and second attachment systems with a snapless fastening material such as Velcro.

The resulting detachable boom is extremely flexible on its vertical axis. By simulating the cork line used in fishing nets by commercial fishermen, the detachable boom with its plurality of floats arrayed along the cork line is very successful at assimilating wave action even in rough and choppy waters, thus allowing the detachable boom to maintain the barrier effect under adverse conditions which have frequently proved the undoing of earlier boom devices. Also, detachable booms constructed in accordance with the present invention can be deployed very quickly at the spill site by vessels moving at high speed.

As stated above, the size and arrangement of floats on the cork line can vary greatly depending on local conditions and the vessels available to deploy the booms. In using the attachment system described above, it has been found that positioning the floats at regular intervals which correspond to the spacing of the top edge slots, top fastening slits, bottom edge slots, bottom fastening slits, and end fastening lines has been successful in providing a boom that is both effective in a variety of weather and water conditions and at the same time is quick and easy to assemble and deploy. Using regular spacings for most, if not all, major measurements also simplifies construction of the detachable boom. Intervals of 18 inches to two feet for top edge slots and top fastening slits in combination with 14-inch long floats spaced four inches apart has been found to work quite well in a variety of different weather and water conditions, thus still preserving the ease and speed of assembly of the detachable boom.

With respect to the diameter of the floats in the float system, diameters from four to eight inches have been used with great success by allowing the detachable boom to assimilate the wave action and maintain the barrier effect of the boom while meeting the practical reality associated with transportation and storage both on land and on board vessels. At the same time, the diameter of the boom system of the floats in the float system could vary widely with particular applications. All of these measurements, of course, can vary greatly, depending upon the weather conditions, the height desired for the boom in the water and the practical limitations and problems of handling increasing float and boom sizes.

Using the embodiment of the present invention as shown in FIG. 1, success has been achieved using a barrier that is 102 feet long and a cork line that is also 102 feet long. When the detachable boom is assembled, the end loops of the cork line and the end edges of the barrier coincide. The weight device is 100 feet six inches so that it is approximately nine inches shorter than the barrier on either end. When it is necessary to attach the detachable boom to the towing bridle described below, the end edges of the barrier are folded back nine inches on either end to expose a portion of the cork line end loop and the connecting ring attached to the elongated weight device end loop.

The barrier can be constructed from a variety of materials. To enhance its ability to contain spilled fluids such as crude oil, water permeable, oil absorbent materials can be used. Success has been had using nonwoven "geotextile" fabrics such as Amoco Construction Fabrics produced by the Amoco Corporation. These fabrics are commercially available and are well known in the road construction industry and the hazardous waste field, but not generally known or used in marine applications.

At the same time there may be situations in which a barrier should water impermeable as well. For this situation, a non-porous material such as heavy gauge polyvinylchloride or plastic-coated fabric could be used. In such a situation, the construction of the barrier with respect to edge slots and edge lines would be virtually identical.

One of the advantages of using a detachable boom constructed in accordance with the present invention is that it can readily be towed. At this time, the upper limit for the speed in which the detachable boom may be towed has not been established. The detachable boom has been used successfully at water speeds of seven to ten knots, where water speed is the combined speed of water current and towing speed of the boom itself. It appears that a detachable boom can be used at water speeds in excess of fifteen knots without losing its barrier effect.

To tow the detachable boom, it is connected to a tow line 68 of a marine vessel, such as a small to medium sized fishing boat 70. One way to connect the detachable boom to the tow line is to use a towing bridle 72 which is shown in detail in FIG. 4. The tow bridle has a main line 74 with first and second end loops 76 and 78 at either end. The towing bridle also has a secondary line 80 which has one end 81 fixedly attached to the towing bridle main line and an end loop 82 attaches the secondary lines to the elongated weight device connecting ring. There is also a support line 83 which attaches one end of the main line to the secondary line end loop.

Connections between end loops of various lines can be made in a number of ways familiar to those skilled in the art, including the use of a device known as a carabiner. The towing bridle described above can be constructed form separate sections of line, or can be constructed from a single length of line long enough to allow the needed loops to be tied in it and to allow the triangular shape to be formed by tying the end of the line back to ring 71.

Figure 4:
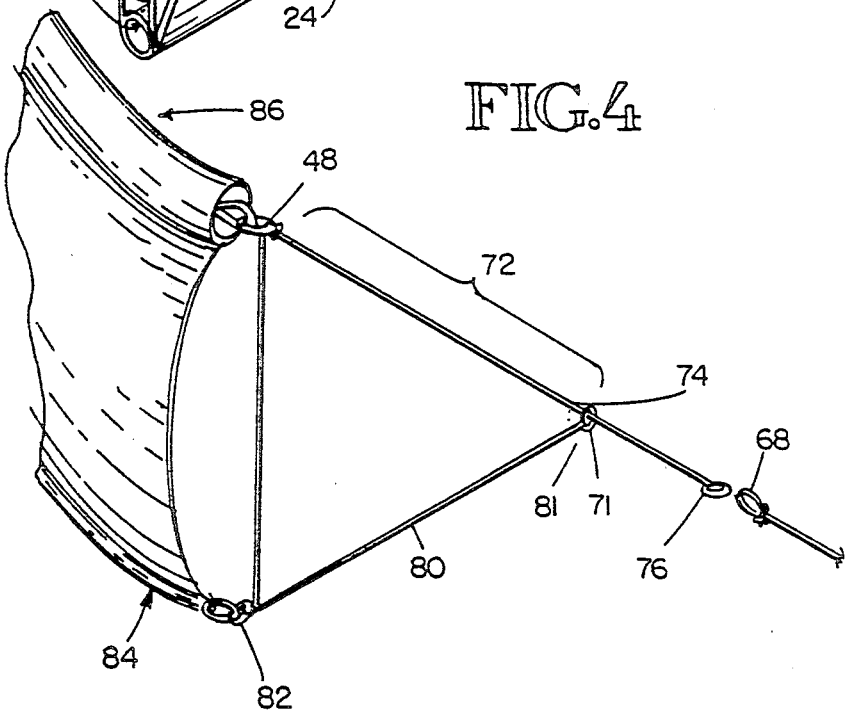
FIG. 4 is a partial side elevation view of an alternative preferred embodiment constructed in accordance with the present invention.
Figure 9:
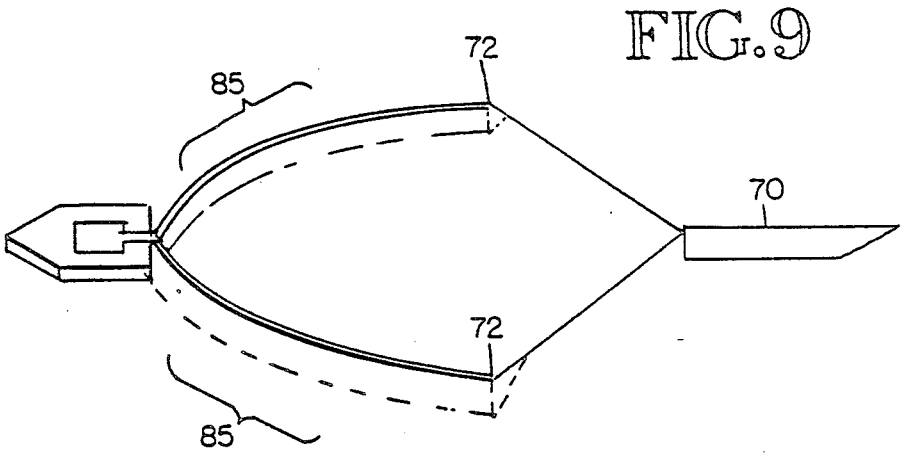
FIG. 9 is a perspective environmental view showing the use of an alternative preferred embodiment constructed in accordance with the present invention.
Figure 14:
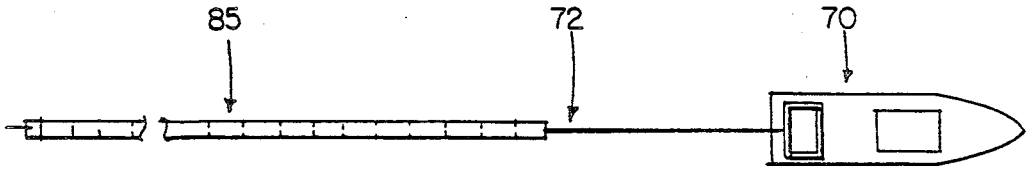
FIG. 14 is a top environmental view of an alternative preferred embodiment constructed in accordance with the present invention as the invention is moved.

The main line first end loop is attached to the marine vessel tow line. The main line second end is attached to the cork line end loop. A secondary end loop is attached to the elongated weight device end loop. When towing, a single vessel may be attached to either end of the detachable boom as shown in FIGS. 5 and 6, or both ends of the detachable boom may be attached to a single vessel as shown in FIG. 9 using two tow lines or using a single tow line (not shown). By using the towing bridle, the barrier bottom 84 and the barrier top 86 are substantially aligned vertically with respect to the direction that the detachable boom is being towed as shown in FIG. 4. The barrier 85 curves rearwardly with respect to the direction towed and has its top and bottom anchored to the float system and the elongated weight device respectively, thus creating a "cupping" effect. This allows this "cupping" effect, which is similar to commercial fishing techniques with nets, allows the detachable boom to be towed while maintaining a barrier effect. Examples of this configuration can be used when towing a detachable boom in perfect accordance with invention are shown in FIGS. 5 and 6. FIG. 7 shows a net that has been towed by a boat 70 and then had the boom pulled into a closed circle where the pollutant can be pumped onto a barge or other container vessel 87 via pump means 88. Also, the detachable boom can be moved quickly from one site to another after it has been deployed by releasing one end of the boom and towing it behind the vessel, as shown in FIG. 14.

Figure 10:
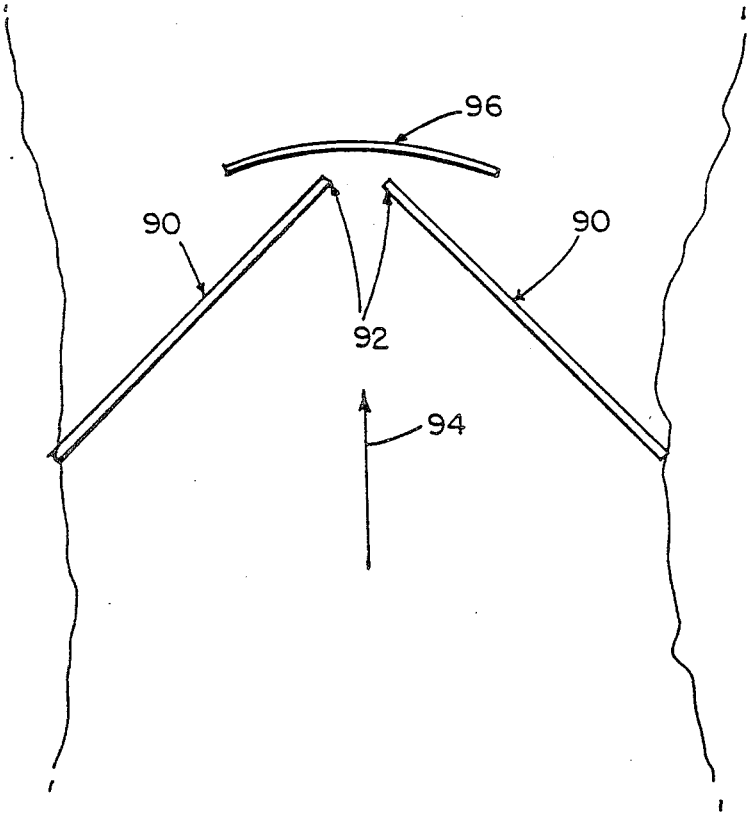
FIG. 10 is a top plan view of an alternative preferred embodiment constructed in accordance with the present invention.

The detachable boom as disclosed in the above embodiment and its variations can also be used in a stationary manner. In this embodiment, illustrated by FIG. 10, two detachable booms 90 that are substantially similar to the above embodiment are arrayed so that they form a V shape with the near ends 92 of each boom not quite closing the point of the V. The current direction 94 heads into the V shape. Behind the open end of the V, a third boom 96 is arrayed in a curved manner. Thus, the polluted water moving on the current is forced by the V shape of the two booms into the point of the V. After passing through the opening in the V, the water is forced against the curved detachable boom. If the current caused by tidal movements of the water, the curvature of third boom is reversed blocking the open point of the V (not shown).

This pattern of V-shaped booms followed by a curved boom can be repeated as many times as necessary to obtain the desired barrier effect against polluted water in the current. As discussed above, the detachable boom is effective at high water speeds whether the boom itself is moving or stationary.

This embodiment is just one of the many possible embodiments in which the detachable boom is used in a stationary manner in bodies of water. In such applications, the elongated weight device is anchored to the bottom. While the float system may also be anchored, this is not critical to the success of the detachable boom as a containment barrier.

Figure 2A:
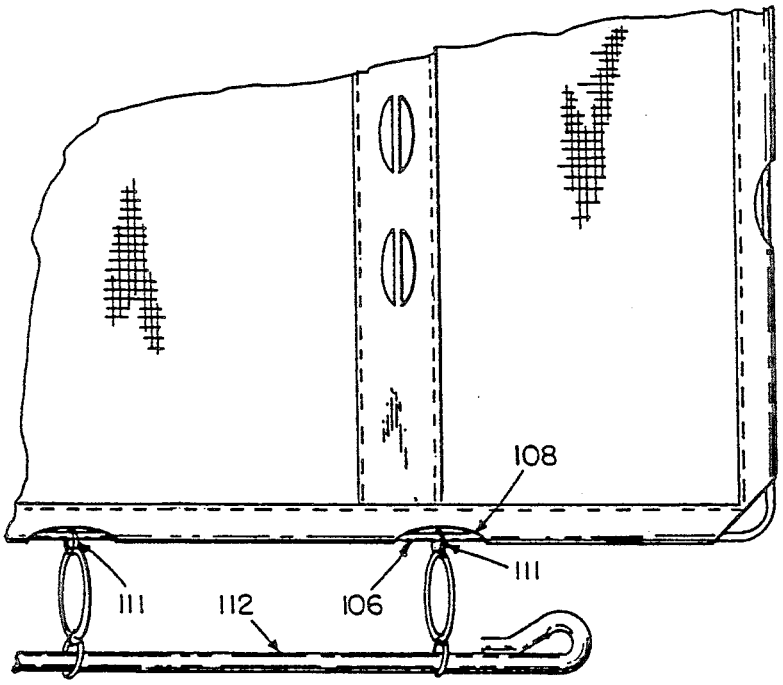
FIG. 2A is an enlarged partial side elevation view of an alternative preferred embodiment constructed in accordance with the present invention.
Figure 2:
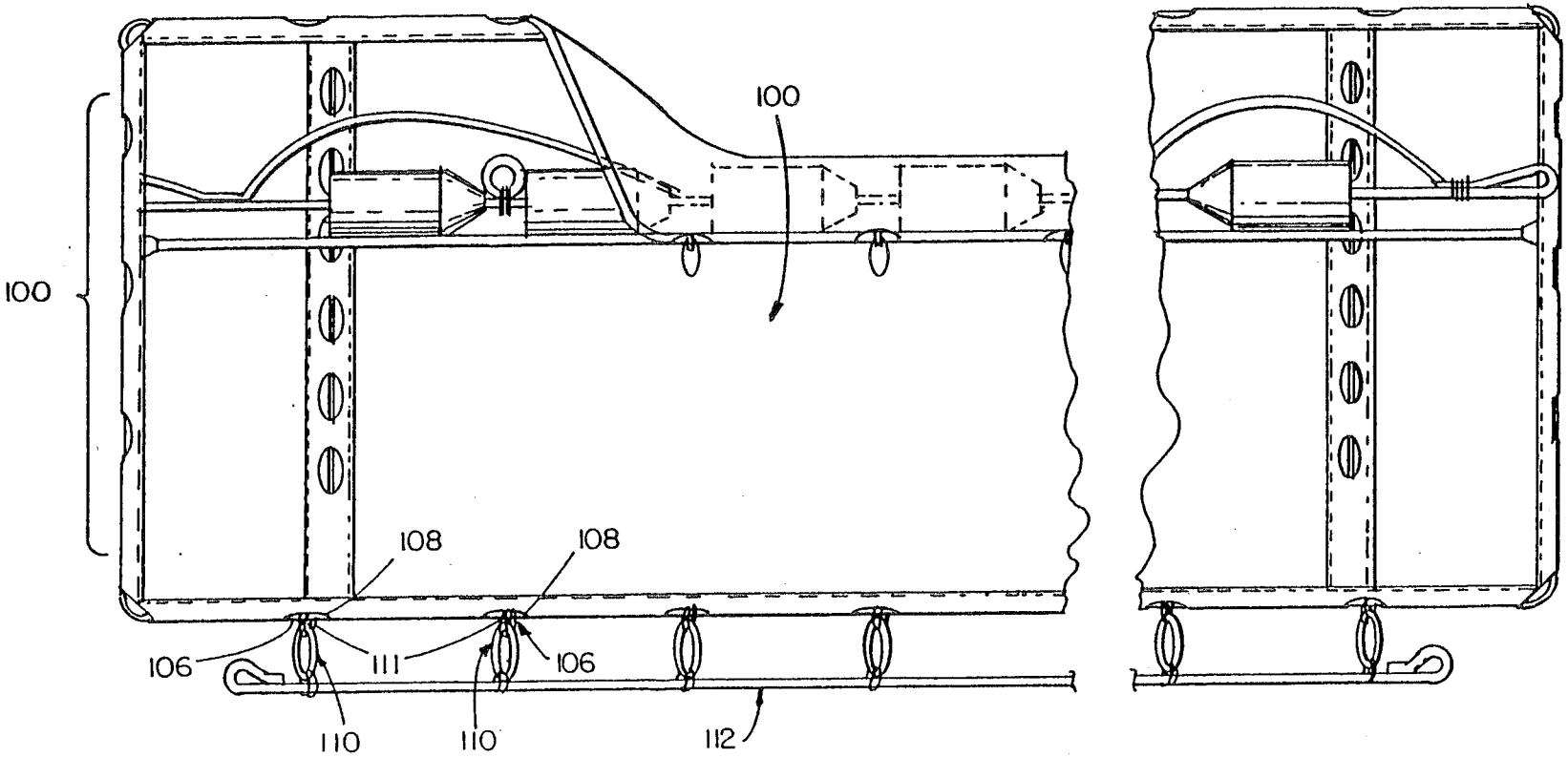
FIG. 2 is a side elevation view of an alternative preferred embodiment constructed in accordance with the present invention.

Another alternative preferred embodiment of the present invention is shown in FIG. 2. In this embodiment the edges of the barrier 100 are prepared as described above. In particular, along the barrier bottom 104 there is a bottom edge line 106 which is exposed along a plurality of bottom edge slots 108. The difference in this embodiment is that at substantially each bottom slot, there is an enclosed loop 110 of material. The loops are permanently affixed to the bottom edge of the line by some means such as a quick-release snap 111. In turn, the elongated weight device 112 is fixedly attached along its length to the plurality of enclosed loops. This embodiment results in the elongated weight device being suspended from the plurality of loops below the barrier.

Figure 8:
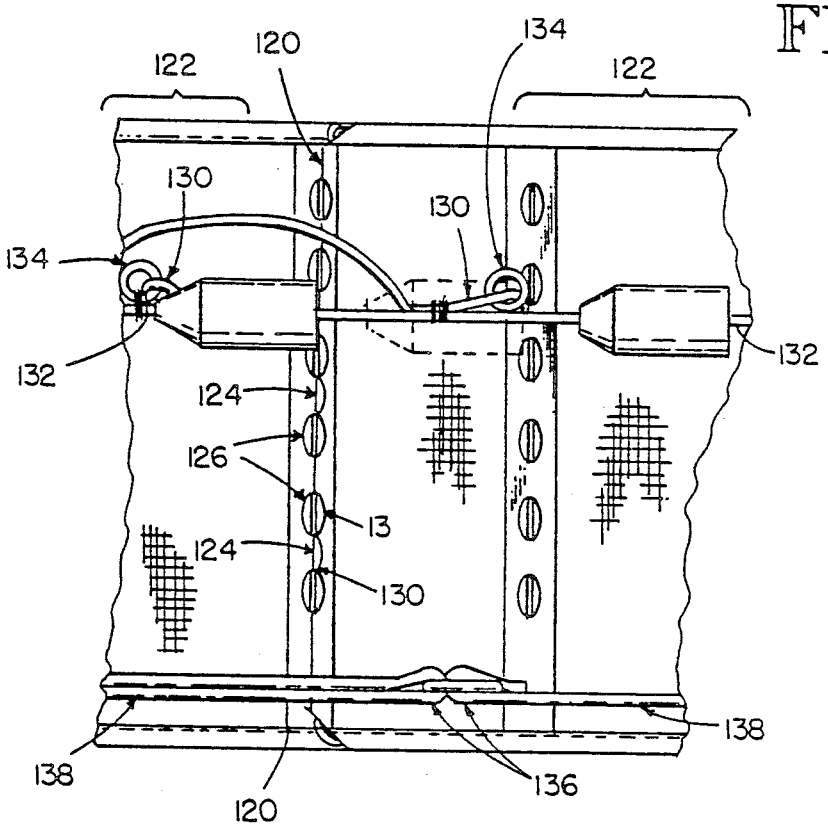
FIG. 8 is a partial side elevation view of an alternative preferred embodiment constructed in accordance with the present invention.

With the embodiments described above, it is possible to connect two or more individual detachable booms to create a longer detachable boom which might be desirable in given environmental situations. This can be achieved as illustrated in FIG. 8. The ends 120 of two booms 122 are overlapped so that the end edge line 124 of each boom is proximate the end fastening line 126 of the other boom. The end edge line of one boom is then attached to the end fastening line of the other boom using a quick-release snap 128 or other fastening means. In addition, the end loop 130 of each cork line 132 is fixedly attached to a ring 134 that is fixedly attached to the cork line. The end loops 136 of the elongated weight devices 138 are also fixedly attached to one another. The result is a detachable boom whose length has been effectively doubled in a manner of minutes and that can be shortened again in the same amount of time. This overlapping system allows the boom to be doubled without moving any of its barrier effect. Experimentation has shown that an overlap of 12 to 18 inches is the minimum amount that will effectively provide a continued barrier effect.

Figure 11:
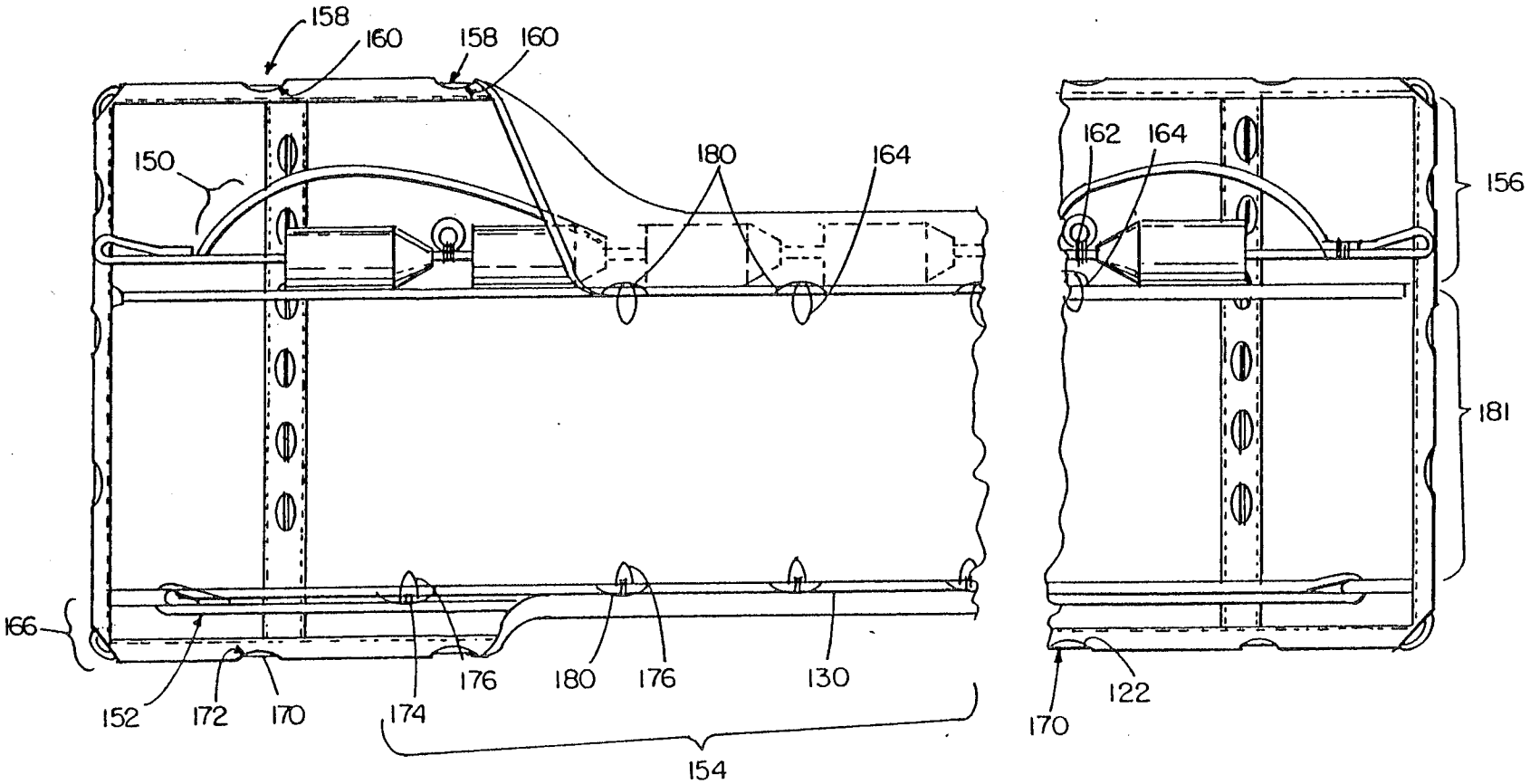
FIG. 11 is a side elevation view of an alternative preferred embodiment constructed in accordance with the present invention.

As shown in FIG. 11, the attachment system used to attach the float system and elongated weight device discussed above in the first embodiment of the present invention is also applicable to commercial fishing nets. In such a situation, a float system 150 substantially similar to the one described above is used, as well as an elongated weight device 152. The net section 154 of this embodiment has a substantially solid piece of material forming a top section 156. This top solid section incorporates top edge line 158 exposed through top edge slots 160, and the top fastening line 162 exposed through top fastening slits 164.

The manner of assembly of the float system and the net section are identical to that described for the above embodiments. Similarly, at the net section bottom 166 a smaller section of substantially solid material extends substantially along the bottom of the net section for its entire length. As with the above embodiment, there is a bottom edge line 170 exposed through a plurality of bottom edge slots 172 and a bottom fastening line 174 exposed through a plurality of bottom fastening slits 176. The bottom edge slits and the bottom edge slots are substantially aligned. The elongated weight device is placed in position, the material is folded over the elongated weight device, and the bottom edge line and bottom fastening line are attached together by some means such as quick-release snaps 180. The actual net 181 is between the solid sections.

Figure 11A:
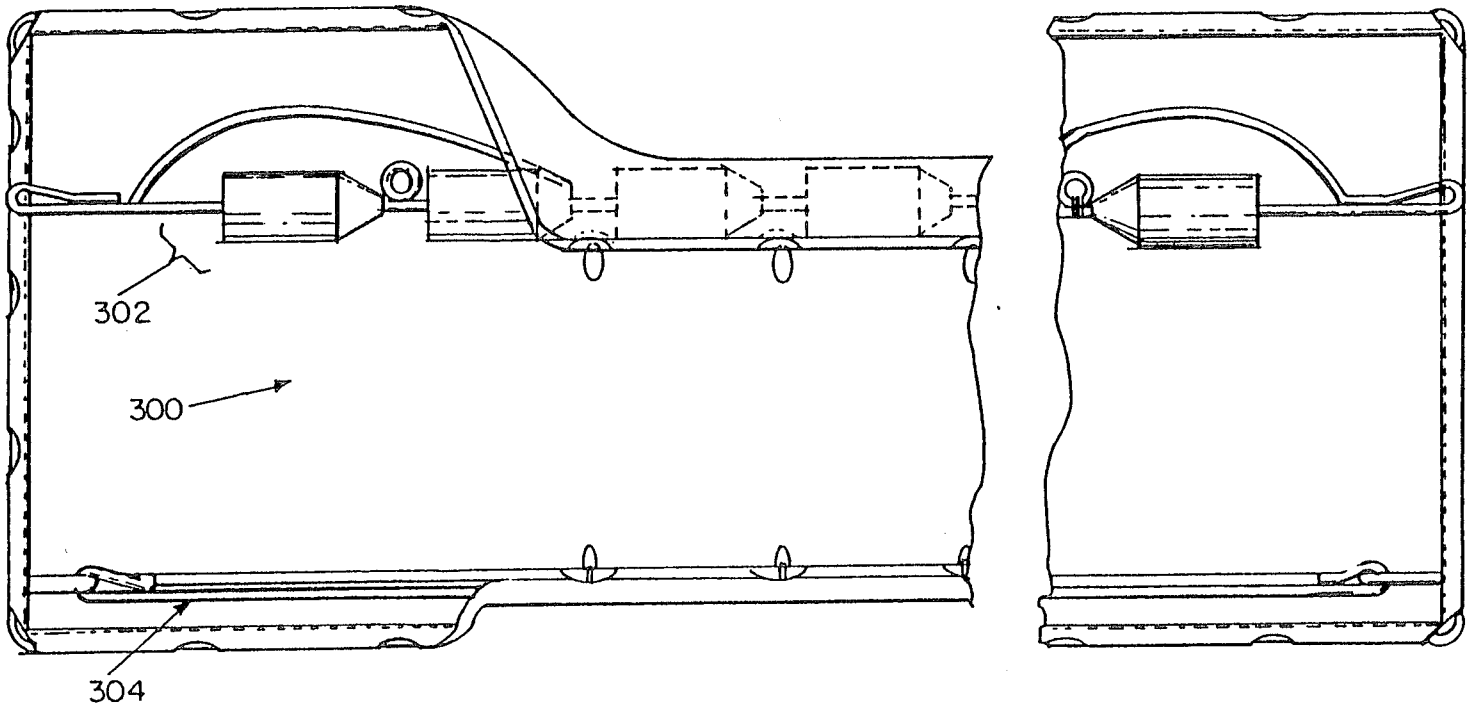
FIG. 11A is a side elevation view of an alternative preferred embodiment constructed in accordance with the present invention.

As shown in FIG. 11A, a standard commercial fishing net 300 can also be used with the float system 302 and elongated weight device 304.

The resulting fishing net allows using the above attachment allows the commercial fishermen to use a set of float systems, a set of elongated weight devices, and a set of net sections by combining these three different components in variations the commercial fisherman can fish in a variety of environmental and water conditions without having to have an expensive, individual net for each different variation in environmental and water condition.

Figure 12:
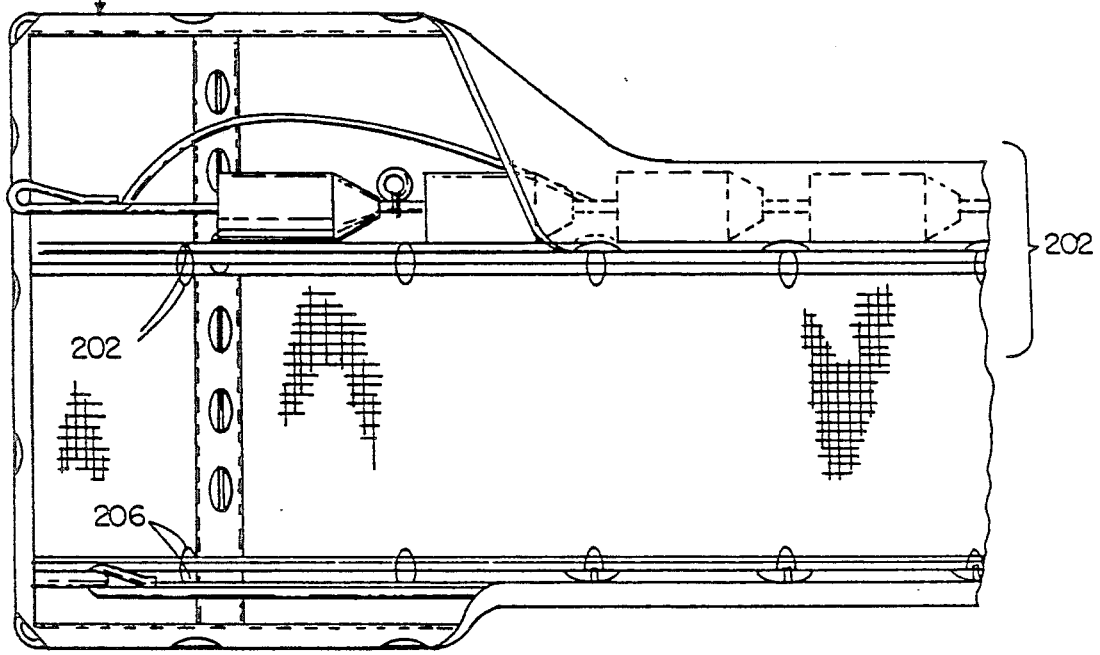
FIG. 12 is a side elevation view of an alternative preferred embodiment constructed in accordance with the present invention.

Another alternative preferred embodiment of the present invention involves a detachable boom assembled substantially in the manner described above. As shown in FIG. 12, this embodiment uses a plurality of substantially parallel top fastening lines 200 extend the length of the barrier 202 and are further substantially parallel to the barrier top edge 204. This embodiment allows a single barrier to be used in a much wider variety of float systems. Due to variations in outer circumference of different sized float systems, there is some limitation to variation in size in a barrier that a single top fastening line and top edge can accommodate. This limitation is overcome with the multiple fastening lines. Similarly, a plurality of bottom fastening lines 206 could be used. Assembly could be facilitated by numbering or color coding the corresponding lines and float systems or weight devices.

Figure 13:
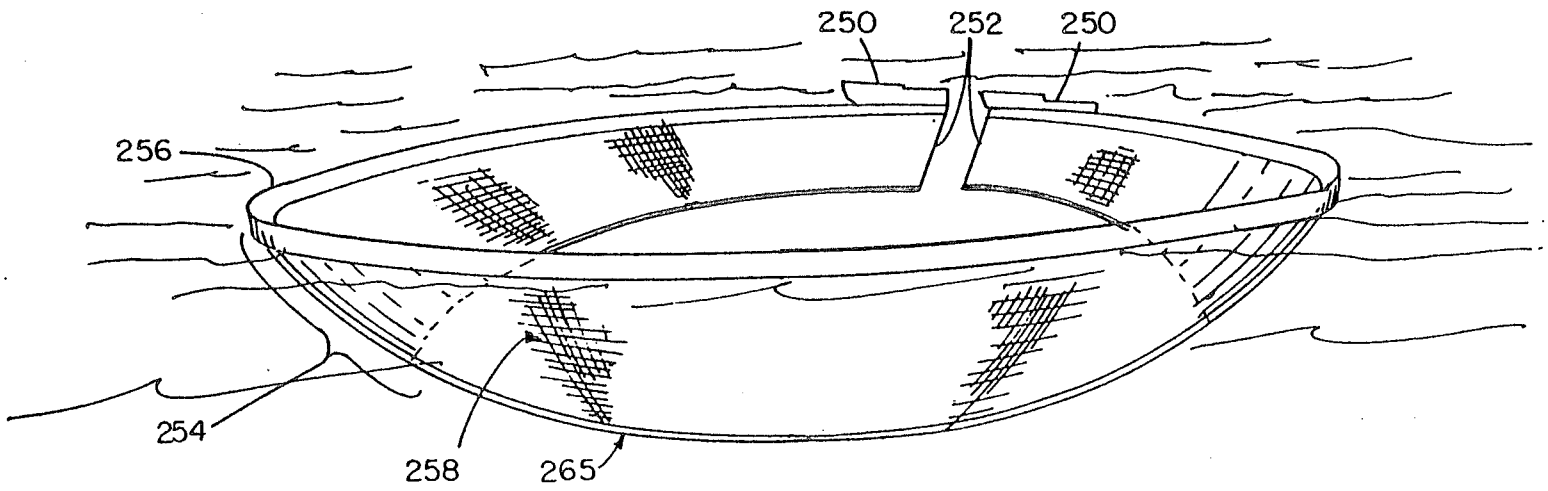
FIG. 13 is a perspective environmental view showing the use of an alternative preferred embodiment constructed in accordance with the present invention.

As shown in FIG. 13 detachable booms constructed in accordance with the present invention can also be used to create a purse seine which would be desirable in certain instances of contaminated water. The vessels 250 create the purse seine by bringing the ends 252 of the detachable boom 254 together. The construction of the detachable boom is similar to the above embodiments with a float system 256, a barrier 258, and an elongated weight device 260. This embodiment typically uses a barrier of greater depth.

Figure 15:
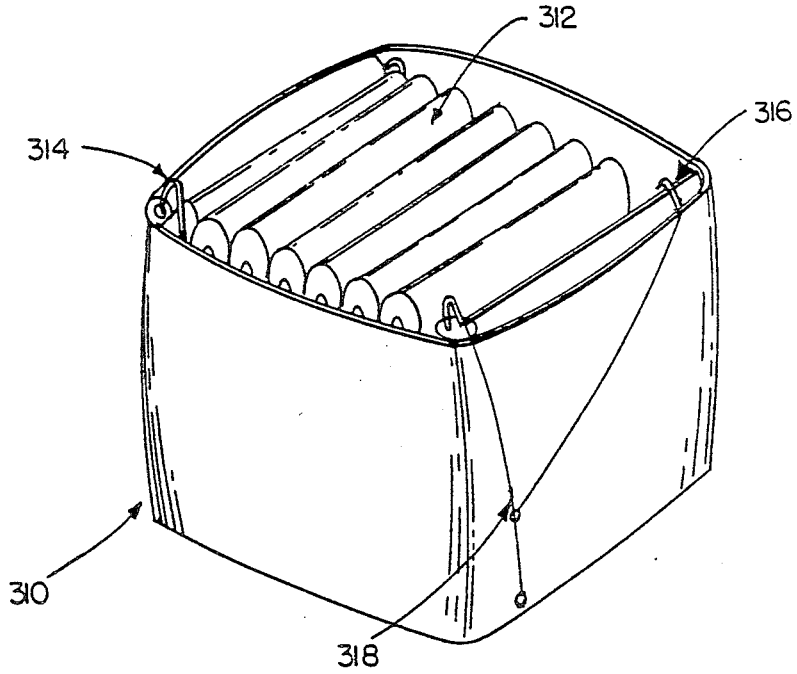
FIG. 15 is a perspective view of an alternative preferred embodiment constructed in accordance with the present invention showing the detachable boom in a bag.

As shown in FIG. 15, a bag 310 is provided. A section 312 of the detachable boom constructed in accordance with the present invention is placed within the bag. A first end 314 of the boom is exposed as is the second end 316. In use, the bag is placed on the deck of a vessel or in a hold with easy access to the vessel. To deploy the boom, the first end of the boom is taken from the bag, attached to a towing bridle 318, and the first end of the boom is moved away from the vessel. At the same time, the second end of the boom is pulled from the bag and either attached to the vessel or connected to a second boom in the manner described above. To speed deployment, the boom ends can be color coded, such as green for the first end and red for the second end. If the bag is constructed of material such as non-woven "geotextile", it is very effective as a storage unit for the soiled barrier, in that it contains the pollutant and allows water to pass from the bag.

Regardless of the embodiment used, the resulting boom is effective in rough or choppy waters, can be used in high currents or towed at high speed, can be easily assembled and disassembled, can be used with all manner of marine vessels including small to medium size fishing boats, and is rugged enough for almost any conditions to be encountered at a spill site.

INDUSTRIAL APPLICABILITY

The present invention is usable in any situation where it is desirable to contain and recover fluids that have been spilled on open water. The present invention also is usable in any application in which nets or net-like devices are deployed in open water of varying conditions.

In compliance with the statute, the invention has been described in language more or less specific as to structural features. It is to be understood, however, that the invention is not limited to the specific features shown, since the means and construction herein disclosed comprise the preferred forms of putting the invention into effect. The invention is claimed in any of its forms or modifications within the legitimate and valid scope of the appended claims.

I claim:

1. A detachable boom for containing and recovering spilled fluids on open water, where said detachable boom comprises:

a float system, said float system having a plurality of individual floats arrayed along and fixedly attached to a flexible, stretch resistant cork line with two ends, said floats having a cross-sectional perimeter length;

a barrier, said barrier being substantially rectangular in shape with a length, a width, a top edge, bottom edge, and two end edges, said barrier further being made from a flexible, stretch resistant material;

a first attachment system, said first attachment system fixedly, but detachably attaching said barrier to said float system substantially along said barrier length, said first attachment system substantially enfolding said float system within said barrier proximate said barrier top edge;

an elongated weight device with two ends, said weight device having a length substantially equal to said barrier length; and a second attachment system, said second attachment system fixedly, but detachably attaching said elongated weight device to said barrier substantially along said barrier length proximate said barrier bottom edge.

2. A detachable boom for containing and recovering spilled fluids on open water as claimed in claim 1, wherein said first attachment system further comprises:

a top edge line having a length, said top edge line length being substantially equal to said barrier length, said top edge line being fixedly attached to said barrier proximate said barrier top edge;

a top fastening line having a length, said top fastening line length being substantially equal to said barrier length, said top fastening line being fixedly attached to said barrier at a position substantially parallel to said barrier top edge and at a distance from said top edge line at least as great as said float cross-sectional perimeter length; and a fastening system, said fastening system fixedly but temporarily attaching said top edge line to said top fastening line along said line length so that when said float system is placed in said barrier along said barrier length between said top edge line and said top fastening line, said barrier can be folded along said barrier length enclosing said float system with said top edge line and said top fastening line being fixedly attached to one another.

3. A detachable boom for containing and recovering spilled fluids on open water as claimed in claim 2, where said first attachment system further comprises:

a plurality of top edge slots arrayed along said barrier top edge and said top edge line exposing said top edge line; and a plurality of top fastening slits, said top fastening slits arrayed along said barrier length proximate said top fastening line, exposing said top fastening line at each top fastening slit.

4. A detachable boom for containing and recovering spilled fluids on open water as claimed in claim 1, wherein said barrier is made of water-permeable, oil-absorbent material.

5. A detachable boom for containing and recovering spilled fluids on open water as claimed in claim 3, wherein said barrier is made of water-permeable, oil-absorbent material.

6. A detachable boom for containing and recovering spilled fluids on open water as claimed in claim 3, wherein said fastening system further comprises a plurality of quick-release snaps which enclose said top fastening line and top edge together when said lines are exposed through said top edge slots and top fastening slits.

7. A detachable boom for containing and recovering spilled fluids on open water as claimed in claim 3, wherein said second attachment system further comprises:

a bottom edge line having a length, said bottom edge line length being substantially equal to said barrier length, said bottom edge line being fixedly attached to said barrier proximate said barrier bottom edge;

a bottom fastening line having a length, said bottom fastening line length substantially equal to said barrier length, said bottom fastening line being fixedly attached to said barrier at a position substantially parallel to said barrier bottom edge and at a distance from said bottom edge line at least as great as said float cross-sectional perimeter length; and a fastening system, said fastening system fixedly but temporarily attaching said bottom edge line to said bottom fastening line along said line length so that when said elongated weight device is placed in said barrier along said barrier length between said bottom edge line and said bottom fastening line, said barrier can be folded along said barrier length enclosing said elongated weight device with said bottom edge line and said bottom fastening line being fixedly attached to one another.

8. A detachable boom for containing and recovering spilled fluids on open water as claimed in claim 7, where said second attachment system further comprises:

a plurality of bottom edge slots arrayed along said barrier bottom edge and said bottom edge line exposing said bottom edge line; and a plurality of bottom fastening slits, said bottom fastening slits arrayed along said barrier length proximate said bottom fastening line, exposing said bottom fastening line at each bottom fastening slit.

9. A detachable boom for containing and recovering spilled fluids on open water as claimed in claim 8 wherein said barrier is made of water-permeable, oil-absorbent material.

10. A detachable boom for containing and recovering spilled fluids on open water as claimed in claim 3 wherein the detachable boom further comprises a towing bridle which attaches said detachable boom to a marine vessel so that said boom can be towed.

11. A detachable boom for containing and recovering spilled fluids on open water as claimed in claim 10, wherein said towing bridle further comprises:

a main line with a first end loop and a second end loop and a secondary line with a first end attached to said main line between said main line first and second end loops, and with a second end with a loop so that said main line second end loop is connected to one said cork line end, said secondary line and loop is connected to one said elongated weight device end, and said main line first end loop is connected to said towing vessel.

12. A detachable boom for containing and recovering spilled fluids on open water as claimed in claim 1, wherein said first attachment system further comprises a snapless fastening material to secure said float system to said barrier after said float system has been enfolded within said barrier, said snapless fastening material extending substantially along said barrier length proximate said barrier top edge.

13. A detachable boom for containing and recovering spilled fluids on open water as claimed in claim 12, wherein said second attachment system substantially enfolds said elongated weight device within said barrier proximate said barrier bottom edge, and wherein second attachment system further comprises a snapless fastening material to secure said elongated weight device to said barrier after said elongated weight device has been enfolded within said barrier, said snapless fastening material extending substantially along said barrier length proximate barrier bottom edge.

14. A detachable boom for containing and recovering spilled fluids on open water as claimed in claim 1, wherein said detachable boom further comprises:

an additional float system, said additional float system having a plurality of individual floats arrayed along and fixedly attached to an additional flexible, stretch resistant cork line with two ends, said floats having a cross-sectional perimeter length;

an additional barrier, said additional barrier being substantially rectangular in shape with a length, a width, a top edge, a bottom edge, and two end edges, said additional barrier further being made from a flexible, stretch resistant material;

an additional first attachment system, said additional first attachment system fixedly, but detachably attaching said additional barrier to said additional float system substantially along said additional barrier length, said additional first attachment system substantially enfolding said additional float system within said additional barrier proximate said additional barrier top edge;

an additional elongated weight device with two ends, said additional weight device having a length substantially equal to said additional barrier length;

an addition second attachment system, said additional second attachment system fixedly, but detachably attaching said additional elongated weight device to said additional barrier substantially along said additional barrier length proximate said additional barrier bottom edge; and an overlapping connection system, said overlapping connecting system using one said barrier end edge and one said additional barrier end edge with said end edges overlapping one another, and with said overlapping end edges attached to each other, and with corresponding overlapping said cork line and additional cork line attached to each other, and with corresponding overlapping said elongated weight device and additional elongated weight device attached together, allowing said barrier and said additional barrier to be connected together to form one connected boom of greater length while retaining flexibility of said barrier and additional barrier at said overlapping.

15. A detachable boom for containing and recovering spilled fluids on open water as claimed in claim 8, wherein said detachable boom further comprises:

an additional float system, said additional float system having a plurality of individual floats arrayed along and fixedly attached to an additional flexible, stretch resistant cork line with two ends, said floats having a cross-sectional perimeter length;

an additional barrier, said additional barrier being substantially rectangular in shape with a length, a width, a top edge, a bottom edge, and two end edges, said additional barrier further being made from a flexible, stretch resistant material;

an additional first attachment system, said additional first attachment system fixedly, but detachably attaching said additional barrier to said additional float system substantially along said additional barrier length, said additional first attachment system substantially enfolding said additional float system within said additional barrier proximate said additional barrier top edge;

an additional elongated weight device with two ends, said additional weight device having a length substantially equal to said additional barrier length;

an additional second attachment system, said additional second attachment system fixedly, but detachably attaching said additional elongated weight device to said additional barrier substantially along said additional barrier length proximate said additional barrier bottom edge; and an overlapping connection system, said overlapping connecting system using one said barrier end edge and one said additional barrier end edge with said end edges overlapping one another, and with said overlapping end edges attached to each other, and with corresponding overlapping said cork line and additional cork line attached to each other, and with corresponding overlapping said elongated weight device and additional elongated weight device attached together, allowing said barrier and said additional barrier to be connected together to form one connected boom of greater length while retaining flexibility of said barrier and additional barrier at said overlapping.

16. A fishing net for recovering fish and marine life on open water, where said fishing net comprises:

a float system, said float system having a plurality of individual floats arrayed along and fixedly attached to a flexible, stretch resistant cork line with two ends, said floats having a cross-sectional perimeter length;

a net section, said net section being substantially rectangular in shape with a length, a width, a top edge, a bottom edge, and two end edges;

a first attachment system, said first attachment system fixedly, but detachably attaching said net section to said float system substantially along said net length, said first attachment system substantially enfolding said float system within said net section proximate said net section top edge;

an elongated weight device with two ends, said weight device having a length substantially equal to said net section length; and a second attachment system, said second attachment system fixedly, but detachably attaching said elongated weight device to said net section substantially along said net section length proximate said net section bottom edge.

17. A fishing net recovering fish and marine as claimed in claim 16, wherein said first attachment system further comprises:

a top edge line having a length, said top edge line length being substantially equal to said net section length, said top edge line being fixedly attached to said net section proximate said net section top edge;

a top fastening line having a length, said top fasting line length being substantially equal to said net section length, said top fastening line being fixedly attached to said net section at a position substantially parallel to said net section top edge and at a distance from said top edge line at least as great as said float cross-sectional perimeter length;

a fastening system, said fastening system fixedly but temporarily attaching said top edge line to said top fastening line along said line length so that when said float system is placed in said net section along said net section length between said top edge line and said top fastening line, said net section can be folded along said net section length enclosing said float system with said top edge line and said top fastening line being fixedly attached to one another;

a plurality of top edge slots arrayed along said net section top edge and said top edge line exposing said top edge line;

a plurality of top fastening slits, said top fastening slits arrayed along said net section length proximate said top fastening line, exposing said top fastening line at each top fastening slit;

a plurality of quick-release snaps which enclose said top fastening line and top edge line together when said lines are exposed through said top edge slots and top fastening slits;

a bottom edge line having length, said bottom edge line length being substantially equal to said net section length, said bottom edge line being fixedly attached to said net section proximate said net section bottom edge;

a bottom fastening line having a length, said bottom fastening line being substantially equal to said net section length, said bottom fastening line being fixedly attached to said net section at a position substantially parallel to said net section bottom edge and at a distance from said bottom edge line at least as great as said float cross-sectional perimeter length;

a plurality of bottom edge slots arrayed along said net section bottom edge and said bottom edge line exposing said bottom edge line;

a plurality a bottom fastening slits, said bottom fastening slits arrayed along said net section length proximate said bottom fastening line, exposing said bottom fastening line at each bottom fastening slit;

a fastening system, said fastening system fixedly but temporarily attaching said bottom edge line to said bottom fastening line along said line length so that when said elongated weight device is placed in said net section along said net section length between said bottom edge line and said bottom fastening line, said net section can be folded along said net section length enclosing said elongated weight device with said bottom edge line and said bottom fastening line being fixedly attached to one another; and a second plurality of quick-release snaps which enclose said bottom fastening line and bottom edge line together when said lines are exposed through said bottom edge slots and bottom fastening slits.

18. A method for retaining and recovering pollutants released on open waters, wherein said method comprises the steps of:

placing a detachable boom with first and second ends, said ends being color coded to differentiate said first end from said second end, a flexible float system, flexible barrier attached to said float system with a first attachment means, a flexible, elongated, weight device attached to said barrier by a second attachment means within a bag so that said first and second boom ends are exposed sufficiently to allow said ends to be identified by said color coding;

placing said bag containing said detachable boom on a marine vessel;

dispatching said marine vessel to the location of the spilled pollutant;

identifying said first boom end by said color coding, removing said first said detachable boom first end from said bag and attaching it to an object, allowing said vessel to move away from said first end;

moving said vessel away from said detachable boom first end allowing said boom to deploy into said open water; and attaching said detachable boom second end to said vessel.

19. A method for containing and recovering pollutants as claimed in claim 18, wherein said method further comprises the step of using water permeable, oil absorbent material for said barrier to maximize containment and recovery of said pollutants.

20. A method for containing and recovering pollutants as claimed in claim 18, wherein said method further comprises the steps of attaching a towing bridle on either end of said detachable boom and to said marine vessel.

* * * * *